United States Patent [19]

Farrell

[11] Patent Number: 4,738,418

[45] Date of Patent: Apr. 19, 1988

[54] ADJUSTABLE SWITCH POINT GUARD

[75] Inventor: Arthur W. Farrell, Naperville, Ill.

[73] Assignee: ABC Rail Corp, Chicago, Ill.

[21] Appl. No.: 909,950

[22] Filed: Sep. 22, 1986

[51] Int. Cl.[4] ..... E01B 7/02

[52] U.S. Cl. ..... 246/435 A; 246/441

[58] Field of Search ..... 246/435 A, 441, 456

[56] References Cited

U.S. PATENT DOCUMENTS

| | | | |
|---|---|---|---|
| 830,402 | 9/1906 | Anderson | 24/435 A |
| 1,586,734 | 6/1926 | Fleming | 246/441 |
| 1,628,882 | 5/1927 | Hoffman et al. | 246/441 |
| 1,826,657 | 10/1931 | Fulton | 246/441 |
| 4,386,751 | 6/1983 | Meyer | 246/441 |

*Primary Examiner*—Kenneth J. Dorner
*Assistant Examiner*—Laurie K. Cranmer
*Attorney, Agent, or Firm*—Thomas S. Baker, Jr.

[57] ABSTRACT

An adjustable switch point guard includes a wear bar rigidly affixed to an adjustment plate. The adjustment plate is mounted on a fixed base plate which is attached to railroad ties. A threaded fastener on one of the adjustment plate or the base plate engages a first pair of bores in the other of the adjustment plate or the base plate to position the wear bar and adjustment plate 54 relative to a switch point and a fixed rail. Additional setes of bores are provided to enable the adjustment plate and wear bar to be moved relative to the base plate.

6 Claims, 1 Drawing Sheet

ADJUSTABLE SWITCH POINT GUARD

BACKGROUND OF THE INVENTION

A railroad switch includes a switch point or rail having a point of switch at one end which terminates in a narrow tip adapted to be moved into contact with a stationary rail when rail traffic is to be diverted from the switch rail to the stationary rail or vice versa. The point of switch which may be three to four feet in length has a relatively thin cross sectional area, i.e., on the order of 1/16 to ¼ of an inch. If as a railroad car or locomotive wheel traverses a switch point it is allowed to engage the point of switch, it will cause this area to wear rapidly thereby necessitating its frequent repair or replacement. The tips of switch points especially are subject to wear when wheels engage the point of switch, because they have the narrowest cross-sectional area and some switch points are equipped with replaceable manganese tips which may be changed when they become worn excessively. In addition, if a wheel is traveling in a facing direction, i.e., towards the point as it moves through a switch and it is allowed to contact the tip, it is possible for the flange of the wheel to climb the switch point rail and become derailed. Also, if a wheel has a worn or thin flange and the tip of the point is worn, a wheel moving in a facing direction may pick the point, i.e., pass between the rail and the point and thereby cause a derailment.

Consequently, it has become common practice to provide a switch point guard rail or bar adjacent the switch point at the point of switch. The guard rail is positioned to engage the rim of a car or locomotive wheel on the side opposite the flange and to push the wheel laterally away from the point of switch so that it is not abraded by the flange as the wheel passes over that area of the switch point. Of course, this causes the guard rail to wear in place of the switch point. Consequently, to maintain the effectiveness of the guard rail, periodically it must be replaced or repositioned to compensate for the wear. Previous switch point guards have been unitary structures which were positioned with respect to switch points by being spiked into ties for the railroad track. A disadvantage inherent in guard rails which are spiked into ties resides in the fact that the spikes must be removed to reposition the guard rails and as these rails are replaced, over a period of time the repeated spiking of the ties renders them useless and they too must be replaced. In response to the disadvantages found in unitary guard rail structures, some guard rail structures have been developed which permit the wear portion of the structure to be replaced or repositioned with respect to the switch point when it becomes worn without moving the portion of the structure spiked to the ties. One problem associated with those guard rail structure having a wear element which may be adjusted or repositioned has been their excessive complexity and their use of relatively large numbers of parts. Often guard rails must be repositioned under adverse weather and working conditions by relatively inexperienced crews. Consequently, those structures employing complex adjustment mechanisms with multiple parts may be improperly installed. Furthermore, complex guard rail structures are expensive and may lack the rigidity required to hold them in a predetermined position under conditions of heavy usage.

It is desirable to provide a guard rail having an adjustable wear element which may be repositioned when the wear element becomes worn to provide additional protection for the point of switch, which utilizes a minimum number of parts and which may be constructed with a minimum of expense. Furthermore, it is desirable to provide a guard rail having an adjustable wear element mounted on a support structure adapted to be spiked to the railroad track ties wherein the wear element may be adjusted or replaced without having to remove the support structure.

SUMMARY OF THE INVENTION

The instant invention provides an adjustable switch point guard for use at the switch point of a railroad track having a wear bar positioned to engage the rims of railroad car wheels to prevent the flanges of the wheels from engaging the switch point. This guard comprises an adjustment plate wherein the wear bar is rigidly affixed to the adjustment plate and located a predetermined lateral distance from the switch point. The wear bar has a vertical wear face which engages the rims of railroad car wheels. The guard includes a base plate which mounts the adjustment plate and an adjustment means for fixedly attaching the adjustment plate to the base plate at a plurality of positions such that the wear bar may be spaced a plurality of predetermined distances from the switch point. The adjustment means includes a plurality of bores formed in one of the adjustment plate or base plate at different lateral distances from the switch point and a threaded connector attached to the other of the base plate or the adjustment plate wherein the threaded connector is installed in one of the bores to locate the adjustment plate and the wear plate at one of the predetermined distances.

Also provided is a method of adjusting a switch point guard for use at the switch point of a railroad track having a wear bar positioned to engage the rims of railroad car wheels to prevent the flanges of the wheels from engaging the switch point. The switch point guard having an adjustment plate and the wear bar being rigidly affixed to the adjustment plate and located a predetermined lateral distance from the switch point. The wear bar has a verticle wear face which engages the rims of railroad car wheels. The switch point guard further having a base plate which mounts the adjustment plate and an adjustment means for fixidly attaching the adjustment plate to the base plate at a plurality of positions such that the wear bar may be spaced a plurality of predetermined distances from the switch point. The adjustment means includes a plurality of bores formed in one of the adjustment plate or the base plate at different lateral distances from the switch point and a threaded connector attached to the of the base plate or the adjustment plate. The threaded connector is installed in one of the bores to locate the adjustment plate and the wear plate at one of said predetermined distances and a nut is turned on to the threaded connector. The method of adjusting the switch point comprises the steps of removing the nut from the threaded connector, lifting the adjustment plate vertically upward from the base plate to withdraw the threaded connector from one of said bores, displacing the adjustment plate laterally and into alignment with another of said bores, lowering the adjustment plate onto the base plate to cause the threaded connector to be received in the other bore and turning the nut onto the threaded connector to fixedly attach the adjustment plate to the base plate.

DISCRIPTION OF THE DRAWINGS

DESCRIPTION OF THE PREFERRED EMBODIMENT

Figure 1:
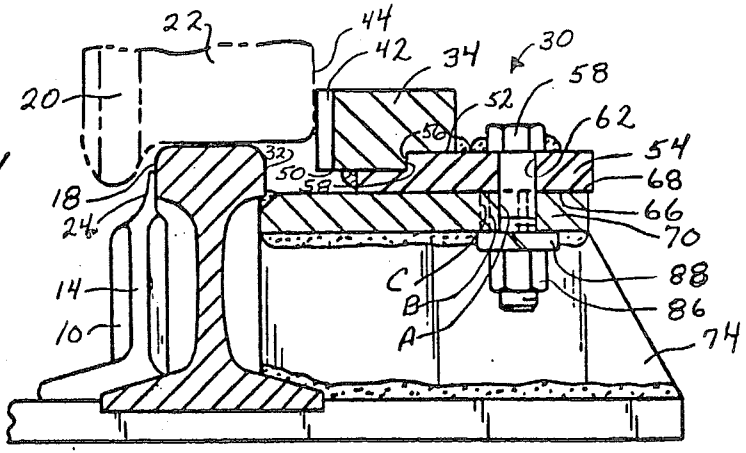
FIG. 1 is a sectional view along line 1—1 of FIG. 2.
Figure 2:
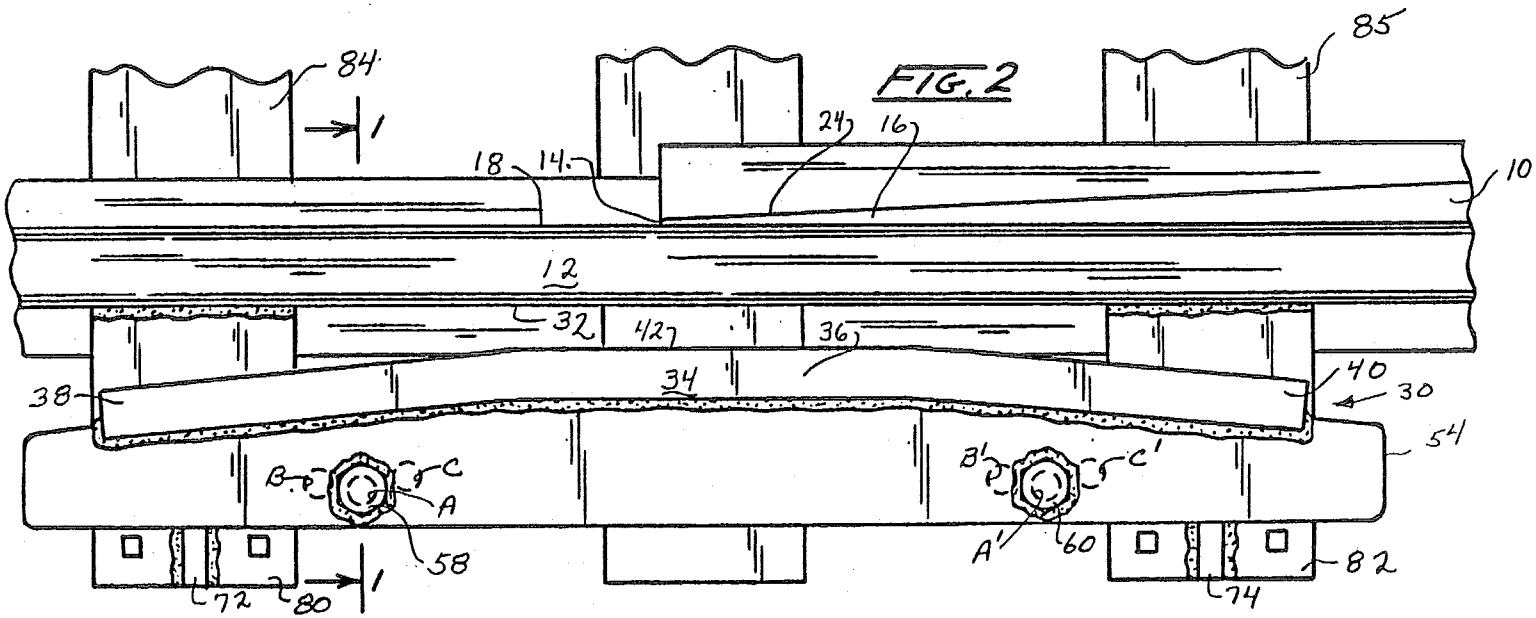
FIG. 2 is a top view of the switch point guard mounted adjacent a switch point.

Referring to FIG. 2, it may be seen that a switch point or rail 10 lies adjacent a fixed traffic rail 12. In this figure, the tip 14 of the tapered point of switch portion 16 of switch point 10 has been brought into contact with the inner edge 18 of fixed rail 10 to obtain a switching condition. With this condition, the flange 20 of a railroad car wheel 22 will engage the inner edge 24 of switch point 10 when the wheel is traveling in a facing direction as may be seen in FIG. 1. If the wheel 22 is traveling in a trailing direction, it will simply transfer from the point of switch portion 16 of switch rail 10 to fixed rail 12 and flange 20 will engage inner edge 18 of that rail to turn the wheel in the direction of rail 12. The point of switch portion 16 of switch point 10 may be moved away from fixed rail 12 to allow traffic to proceed along rail 12 without entering switch point 10.

A guard rail assembly 30 is mounted along a railroad track adjacent the outer edge 32 of fixed rail 12. Referring again to FIG. 2, it may be seen that rail assembly 30 includes a wear bar 34 having a straight midsection 36 which lies parallel to fixed rail 12 and a pair of tapered ends 38 and 40 which are attached to opposite ends of midsection 36. Wear bar 34 has a verticle face 42 which engages the outer edge 44 of a car wheel 22 to push the wheel away from tip 14 and inner edge 24 of the point of switch 16 as depicted in FIG. 1. As a result, abrasion and wear of the inner edge 24 of point of switch 16 by wheel flanges 20 is prevented when the wheels traverse switch point 10. Typically, wear bar 34 is manufactured from a wear resistant alloy or subjected to a manufacturing process which increases is resistance to wear and abrasion. However, repeated contact with the outer edges 44 of car wheels 22 causes wear face 42 eventually to wear. When the wear reaches the point to where the flange 20 of the wheel 22 is not maintained a sufficient distance from tip 14 and inner edge 24 of point of switch 16, wear bar 34 must be replaced or repositioned. The guard rail assembly 30 of the present invention provides an adjustment whereby wear bar 34 may be moved inwardly towards fixed rail 12 to compensate for wear twice subsequent to its initial installation. Thereafter, wear bar 34 must be replaced.

Guard rail assembly 30 will now be discribed in detail. Wear bar 34 has a stepped bottom surface 50 that is mounted on a complimentary stepped top surface 52 of an adjustment plate 54. A plurality of welded joints secure wear bar 34 to adjustment plate 54. A verticle edge 56 formed on the top of adjustment plate 54 acts against a similar edge 58 formed on the bottom of wear bar 34 to resist lateral movement of the bar when the outer edge 44 of a car wheel 52 engages verticle face 42.

A pair of threaded fasteners 58 and 60 pass through bores 62 formed in adjustment plate 54. Fasteners 58 and 60 may be bolts which are retained in place by welding. Alternatively, bores 62 may be threaded and fasteners 58 and 60 may be threaded studs that are turned into bores 62.

The bottom surface 66 of adjustment plate 54 rests upon the top surface 68 of a horizontally extending base plate 70. Base plate 70 is supported by a pair of vertically extending gussets 72 and 74. The top surfaces of gussets 72 and 74 are rigidly affixed to the bottom surface 76 of base plate 70 by welds. Gussets 72 and 74 are mounted on end tie plates 80 and 82, respectively. Tie plates 80 and 82 are spiked into railroad ties 84 and 85 to secure guard rail assembly 30 in position adjacent to fixed rail 12 and switch point 10. Three pairs of bores A and A', B and B', and C and C' are formed in base plate 70. The center lines of each pair of bores, A and A', B and B' and C and C', are spaced apart by the same distance that separates the center lines of fasteners 58 and 60. In order to mount wear bar 34 and adjustment plate 54 on base plate 70, adjustment plate 54 is moved until threaded fasteners 58 and 60 are aligned with one of the pairs of bores. When wear bar 34 is new, fasteners 58 and 60 are aligned with bores A and A' as shown in FIGS. 1 and 2 and the fasteners are inserted into these bores. Thereafter, nuts 86 are turned onto fasteners 58 and 60 until they engage and compress lock washers 88 to thereby secure adjustment plate 54 to base plate 70.

It may be observed that bores B and B' are positioned inwardly of bores A and A' towards fixed rail 12 and that bores C and C' are positioned inwardly of bores B and B' towards fixed rail 12. Consequently, when wear bar 34 becomes worn in the initial position, it may be moved to a second position in which fasteners 58 and 60 pass through bores B and B'. When wear bar 34 becomes worn in the second position, it may thereafter be moved to a third position in which the fasteners 58 and 60 pass through bores C and C' respectively. Bore B and B' are offset laterally to one side of bores A and A', respective, and bores C and C' are offset laterally to the opposite side of bores A and A', respectively, so that wear bar 34 remains close to its initial position as defined by bores A and A' when it is in the second and third position.

In order to reposition adjustment plate 54 and wear bar 34 from one set of bores to another, it is necessary only to remove the nut 86 and washers 88 from fasteners 58 and 60 and, lift adjustment plate 54 vertically upward from base plate 70 to withdraw the fasteners 58 and 60 from the bores they occupy. Thereafter, adjustment plate 54 is moved horizontally until fasteners 58 and 60 are aligned with the bores in base plate 70 which define the next desired position for wear bar 34. Subsequently, plate 54 is lowered onto base plate 70 and thereafter nuts 86 are turned onto fasteners 58 and 60 until their lock washers 88 are compressed.

Although in the preferred embodiment the threaded fasteners are shown mounted on the adjustment plate 54 and the sets of positioning bores A and A', B and B' and C and C' are shown formed in base plate 70, the adjustment mechanism, would work equally well if the threaded fasteners 58 and 60 projected upwardly from the top surface 68 of base plate 70 and the adjustment bores A and A', B and B' and C and C' were formed in adjustment plate 54. In this instance, adjustment plate 54 would be repositioned on base plate 70 by removing the nut 86 and washer 88 from each threaded fastener 58 and 60, lifting adjustment plate 54 vertically upward from base plate 70 to cause fasteners 58 and 60 to be withdrawn from one of the sets of bores. Thereafter adjustment plate 54 would be moved to align the set of bores defining the desired position with fasteners 58 and 60 and would be lowered onto base plate 70 such that fasteners 58 and 60 would pass through the selected set of bores. Adjustment plate 54 would be secured onto base plate 70 by turning a nut 86 onto each fastener 58 and 60 until it compressed the lock washer 88.

It may be observed that adjustment plate 54 and wear bar 34 may be removed from base plate 70 and replaced or repositioned thereon without disturbing the base plate 70. Consequently, the support structure consisting of base plate 70, gussets 72 and 74 and end tie plates 80 and 82 remain in position when adjustment plate 54 and wear bar 34 are repositioned or replaced. Thus, end tie plates 80 and 82 are spiked into railroad ties 84 and 85 when the guard rail assembly 30 is installed initially and are not disturbed when wear bar 34 and adjustment plate 54 are replaced or repositioned.

Since certain changes may be made in the above-described system and apparatus without departing from the scope of the invention herein involved, it is intended that all matter contained in the description or shown in the accompanying drawings shall be interpreted as illustrative and not in a limiting sense.

I claim:

1. An adjustable switch point guard for use at the switch point of a railroad track having a wear bar positioned to engage the rims of railroad car wheels to prevent the flanges of the wheels from engaging the switch point which comprises:

an adjustment plate;

said wear bar rigidly affixed to said adjustment plate and located a predetermined lateral distance from said switch point;

said wear bar having a vertical wear face which engages the rims of railroad car wheels;

a base plate which mounts said adjustment plate;

a plurality of lateral adjustment means for fixedly attaching said adjustment plate to said base plate at a plurality of lateral positions such that said wear bar may be spaced a plurality of predetermined lateral distances from said switch point; and each of said lateral adjustment means including a plurality of bolt receiving adjustment bore means formed in one of said adjustment plate or said base plate at different lateral distances from said switch point and a threaded connector means attached to the other of said base plate or said adjustment plate; and said threaded connector being installed in one of said bolt receiving bore means to thereby locate to said adjustment plate and said wear bar at one of said plurality of predetermined lateral distances and to firmly affix said adjustment plate to said base plate.

2. The adjustable switch point guard of claim 1 which includes:

a plurality of vertically extending gussets which mount said base plate;

a tie plate connected to each gusset; and connecting means for connecting said tie plates to rail ties.

3. The switch point guard of claim 1 in which the plurality of bolt receiving bore means includes three bores formed in one of said adjustment plate or said base plate at different lateral distances from said switch point.

4. The adjustable switch point guard of claim 1 in which:

a nut is turned onto said threaded connector means subsequent to said threaded connector being installed in one of said bolt receiving adjustment bore means.

5. The switch point guard of claim 4 in which: said threaded connector means is welded to said adjustment plate.

6. A method of adjusting a switch point guard utilizing the switch point guard of claim 3 comprising the steps of:

removing said nut from said threaded connector means;

lifting said adjustment plate vertically up from said base plate to withdraw said threaded connector from said one of said bolt receiving adjustment bores;

displacing said adjustment plate laterally and aligning said threaded connector means with another of said bores;

lowering said adjustment plate onto said base plate to cause said threated connector means to be received in said other bore; and turning said nut onto said threaded connector means to fixedly attach said adjustment plate to said base plate.

* * * * *